US012460337B2

(12) United States Patent
Zhang et al.

(10) Patent No.: US 12,460,337 B2
(45) Date of Patent: Nov. 4, 2025

(54) CONTROL METHOD OF WASHING MACHINE AND WASHING MACHINE

(71) Applicants: QINGDAO HAIER WASHING MACHINE CO., LTD., Shandong (CN); HAIER SMART HOME CO., LTD., Shandong (CN)

(72) Inventors: Shuxia Zhang, Shandong (CN); Zhenxing Huang, Shandong (CN); Sheng Xu, Shandong (CN)

(73) Assignees: QINGDAO HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 225 days.

(21) Appl. No.: 18/255,002

(22) PCT Filed: Oct. 20, 2021

(86) PCT No.: PCT/CN2021/124925
§ 371 (c)(1),
(2) Date: May 30, 2023

(87) PCT Pub. No.: WO2022/111142
PCT Pub. Date: Jun. 2, 2022

(65) Prior Publication Data

US 2024/0003072 A1 Jan. 4, 2024

(30) Foreign Application Priority Data

Nov. 30, 2020 (CN) ..... 202011377235.4

(51) Int. Cl.
*D06F 34/05* (2020.01)
*D06F 33/52* (2020.01)
(Continued)

(52) U.S. Cl.
CPC ..... *D06F 34/05* (2020.02); *D06F 33/52* (2020.02); *D06F 34/30* (2020.02); *D06F 34/32* (2020.02);
(Continued)

(58) Field of Classification Search
CPC ..... D06F 34/05
See application file for complete search history.

(56) References Cited

U.S. PATENT DOCUMENTS

2012/0137739 A1* 6/2012 Hong ..... D06F 34/28 68/13 R
2018/0305851 A1* 10/2018 Kwon ..... H04L 12/2825
(Continued)

FOREIGN PATENT DOCUMENTS

CN 108505289 A 9/2018
CN 208545582 U 2/2019
(Continued)

OTHER PUBLICATIONS

EP2545216B1 Machine Translation (Year: 2018).*
(Continued)

*Primary Examiner* — Spencer E. Bell
(74) *Attorney, Agent, or Firm* — Panitch Schwarze Belisario & Nadel LLP

(57) ABSTRACT

The washing machine includes control buttons controlling the washing machine to operate, and the washing machine is controlled to be connected/disconnected with a WiFi/to enter in a WiFi configuration mode by obtaining a trigger duration of one of the control buttons. The washing machine is controlled to be connected/disconnected with the WiFi/to enter in the WiFi configuration mode through the trigger duration of the control buttons, which realizes connection controllability of the washing machine and the WiFi, a user can control whether the washing machine is connected with the WiFi and enters in the WiFi configuration mode to configure a connection of the washing machine and the WiFi according to his/her own needs, which avoids conditions that the washing machine is directly connected with the WiFi and the user controls the washing machine mistakenly, and the safety of remote control of the washing machine is improved.

11 Claims, 4 Drawing Sheets

(51) Int. Cl.

| | |
|---|---|
| ***D06F 34/30*** | (2020.01) |
| ***D06F 34/32*** | (2020.01) |
| ***D06F 103/40*** | (2020.01) |
| ***D06F 105/50*** | (2020.01) |
| ***D06F 105/54*** | (2020.01) |
| ***D06F 105/56*** | (2020.01) |
| ***D06F 105/62*** | (2020.01) |

(52) U.S. Cl.
CPC ..... *D06F 2103/40* (2020.02); *D06F 2105/50* (2020.02); *D06F 2105/54* (2020.02); *D06F 2105/56* (2020.02); *D06F 2105/62* (2020.02)

(56) References Cited

U.S. PATENT DOCUMENTS

| | | | | |
|---|---|---|---|---|
| 2019/0024284 | A1* | 1/2019 | Xu | D06F 33/52 |
| 2021/0269959 | A1* | 9/2021 | Park | D06F 34/04 |

FOREIGN PATENT DOCUMENTS

| | | | | |
|---|---|---|---|---|
| CN | 110438726 | A | 11/2019 | |
| EP | 2545216 | B1 * | 5/2018 | A47L 15/006 |
| EP | 3396050 | A1 * | 10/2018 | D06F 33/30 |
| RU | 2673464 | C1 | 11/2018 | |

OTHER PUBLICATIONS

International Search Report (PCT/ISA/210) with English translation and Written Opinion (PCT/ISA/237) mailed on Feb. 9, 2022, by the Chinese Patent Office as the International Searching Authority for International Application No. PCT/CN2021/124925.

* cited by examiner

CONTROL METHOD OF WASHING MACHINE AND WASHING MACHINE

TECHNICAL FIELD

The present disclosure relates to the technical field of mechanical devices, in particular to a control method of a washing machine and the washing machine.

BACKGROUND

With the development of a communication network technology and continuously-improved people's requirements for household products, more and more Internet of Things intelligent household appliances are coming into people's attention, for example, washing machines, refrigerators, televisions, microwave ovens, etc. will all join the list of connectivity, and finally form a globally unified "Internet of Things".

The intelligent household appliances are generally controlled by intelligent terminals at present. A wireless communication module is additionally installed on the intelligent terminals and the intelligent household appliances to achieve an internet communication connection of the intelligent terminals and the intelligent household appliances. The intelligent household appliances may be remotely controlled by installing an app client on intelligent terminal devices (such as a mobile phone, a PAD, a PC, etc.).

The first step to remotely control the intelligent household appliances is to connect the intelligent household appliances to an internet, current mainstream intelligent household appliances such as a washing machine, once being switched on, will be automatically connected to a WiFi wireless network, further, an intelligent terminal of a user may also be automatically connected with the washing machine, and manual control connection is not needed.

However, the washing machine is different from other Internet of Things products, and certain safety problems exist in the washing machine during working. At present, the user cannot know a state of the washing machine remotely, for example, whether the washing machine works properly, whether a door cover is in a locked state, whether a kid or a pet is nearby the washing machine or in an inner drum of the washing machine, in response to determining that the washing machine randomly authorizes the intelligent terminal to remotely control the washing machine, the user rashly remotely controls the washing machine to operate, potential safety hazards will be generated, and the kid and the pet will be harmed In view of this, the present disclosure is put forward.

SUMMARY

The technical problems to be solved by the present disclosure is to overcome the problem that an existing washing machine will be directly connected with a WiFi network once switched on, a user is prone to controlling the washing machine to operate by mistake in a case of not knowing a current state of the washing machine, and potential safety hazards will be caused. A control method of a washing machine and the washing machine are provided, so that the washing machine achieves an intelligent connection and configuration with a WiFi, which improves the safety of remote control of the washing machine.

In order to solve the technical problems, a basic conception of the technical solution adopted by the present disclosure is that the washing machine includes control buttons controlling the washing machine to operate, and the washing machine is controlled to be connected with/disconnected with a WiFi/to enter in a WiFi configuration mode by obtaining a trigger duration of one of the control buttons.

Further, when the washing machine is connected with the WiFi, the washing machine is controlled to be continuously connected/disconnected/continuously connected with the WiFi and to enter in the WiFi configuration mode by obtaining the trigger duration of the control button; and when the washing machine is disconnected with the WiFi, the washing machine is controlled to be continuously disconnected/to be switched on/to be switched on and enter in the WiFi configuration mode by obtaining the trigger duration of the control button.

Further, the WiFi configuration mode includes presetting connection duration time $t_0$ of the washing machine and the WiFi, and Obtaining continuous connection time t of the washing machine and the WiFi, and when the continuous connection time t of the washing machine and the WiFi satisfies $t \geq t_0$, the connection of the washing machine and the WiFi is controlled to enter in a low-power consumption mode.

Further, the low-power consumption mode is that the washing machine is controlled to be automatically disconnected with the WiFi at an interval of every $\Delta t_1$ time, the washing machine is controlled to be connected with the WiFi after connection for $\Delta t_2$ time, and the process is repeated.

Further, the washing machine includes a washing procedure and a drying procedure, the WiFi configuration mode includes that in a process of the washing machine executing the washing procedure or the drying procedure, the connection of the washing machine and the WiFi is controlled to be automatically disconnected, and when the washing procedure or the drying procedure is terminated, the washing machine is controlled to be automatically connected with the WiFi.

Further, each control button includes a power button, a trigger duration of the power button is preset to be $t_1$, $t_2$, $t_3$, and $t_1<t_2<t_3$,

- when the obtained trigger duration of the power button satisfies $t \leq t_1$, the washing machine is controlled to be switched on/off;
- when the obtained trigger duration of the power button satisfies $t_1<t \leq t_2$, the washing machine is controlled to be continuously connected/continuously disconnected with the WiFi;
- when the obtained trigger duration of the power button satisfies $t_2<t \leq t_3$, the washing machine is controlled to enter in the WiFi configuration mode; and
- when the obtained trigger duration of the power button satisfies $t>t_3$, the washing machine is controlled to be connected/disconnected with the WiFi.

Further, the washing machine further includes an intelligent terminal touch module, when the washing machine is connected with the WiFi, the intelligent terminal touch module receives a touch signal to control the washing machine to be connected/disconnected with an intelligent terminal.

Further, the washing machine further includes a door body detecting module for detecting whether a door body of the washing machine is closed;

- when the washing machine is connected with the WiFi, the intelligent terminal touch module receives the touch signal, and when the door body detecting module detects that the door body is closed, the washing machine is controlled to be connected with the intelligent terminal; and otherwise, the washing machine is controlled to be disconnected with the intelligent terminal.

Further, when the washing machine is connected with the WiFi and is not connected with the intelligent terminal, the intelligent terminal touch module receives the touch signal to control the washing machine to be connected with the intelligent terminal; when the washing machine and the intelligent terminal are in a connection state, if the intelligent terminal touch module receives the touch signal, the washing machine is controlled to be disconnected with the intelligent terminal;

preferably, the washing machine includes an image obtaining module, the washing machine/the intelligent terminal prestores picture information of family members to form an information base, and divides the picture information into a touchable washing machine category and an untouchable washing machine category;

when the washing machine and the intelligent terminal are in the connection state and the intelligent terminal touch module receives the touch signal, the image obtaining module is controlled to collect picture information of a current touch signal sender, and match the collected picture information with the picture information in the information base;

when the picture information of the current touch signal sender belongs to the touchable washing machine category, the washing machine is controlled to be continuously connected with the intelligent terminal; and otherwise, the washing machine is controlled to be disconnected with the intelligent terminal.

The present disclosure further discloses a washing machine, being controlled by adopting any one of the control method of the above solution.

By adopting the above technical solution, compared with the prior art, the present disclosure has the following beneficial effects.

1. The washing machine is controlled to be connected with/disconnected with the WiFi/to enter in the WiFi configuration mode through the trigger duration of the control buttons, which realizes connection controllability of the washing machine and the WiFi. Users can control whether the washing machine is connected with the WiFi and enters the WiFi configuration mode to configure a connection of the washing machine and the WiFi according to their own needs, which avoids conditions that the washing machine is directly connected with the WiFi and the user a control the washing machine by mistake, and the safety of remote control of the washing machine is improved.

2. When continuous connection time of the washing machine and the WiFi t is $t \geq t_0$, which indicates that the connection time of the washing machine and the WiFi is long, control use of the washing machine by the user has been completed with high probability, the user may not operate the washing machine frequently. At the moment, the connection of the washing machine and the WiFi is controlled to enter in the low-power consumption mode, which not only saves electric energy of the washing machine, but also prevents the washing machine from being continuously connected with the WiFi to occupy a home network of the user and reduces the internet speed of the home network.

3. When the washing machine is in the process of executing the washing procedure or the drying procedure, the user does not need to control the washing machine in real time, at the moment, the washing machine is controlled to be disconnected with the WiFi, which can effectively prevent the washing machine from occupying home network signals; and when the washing procedure or the drying procedure is terminated, the user may need to control the procedure of the washing machine, at the moment, the washing machine is controlled to be connected with the WiFi, which facilitates remote control over the washing machine by the user.

4. The power button may control the washing machine to be switched on and switched off, and may also control the connection/disconnection/configuration of the washing machine and the WiFi, which realizes the functional diversification of the power button.

5. The intelligent terminal touch module receives the touch signal to control the washing machine to be in a communication connection with the intelligent terminal through a network signal, and the user may remotely control the washing machine through the intelligent terminal without being limited by geography, time and space; and when the washing machine has been connected with the intelligent terminal, the touch module receives the touch signal, which indicates that a person or a pet appears nearby the washing machine at the moment, the washing machine is controlled to be disconnected with the intelligent terminal, the user is prevented from unknowingly controlling the washing machine to operate and causing harm to the person/pet nearby the washing machine, and the use safety of the washing machine is improved.

The specific implementation modes of the present disclosure are further described in detail with reference to accompanying drawings below.

BRIEF DESCRIPTION OF THE DRAWINGS

Accompanying drawings are regarded as a part of the present disclosure, and are configured to provide a further understanding to the present disclosure, and schematic embodiments and descriptions of the present disclosure are configured to illustrate the present disclosure, but do not form improper limitations to the present disclosure. Apparently, the accompanying drawings in the descriptions below are merely some of the embodiments of the present disclosure, and based on which other accompanying drawings may further be obtained by those of ordinary skill in the art without any creative effort. In the accompanying drawings.

Figure 1:
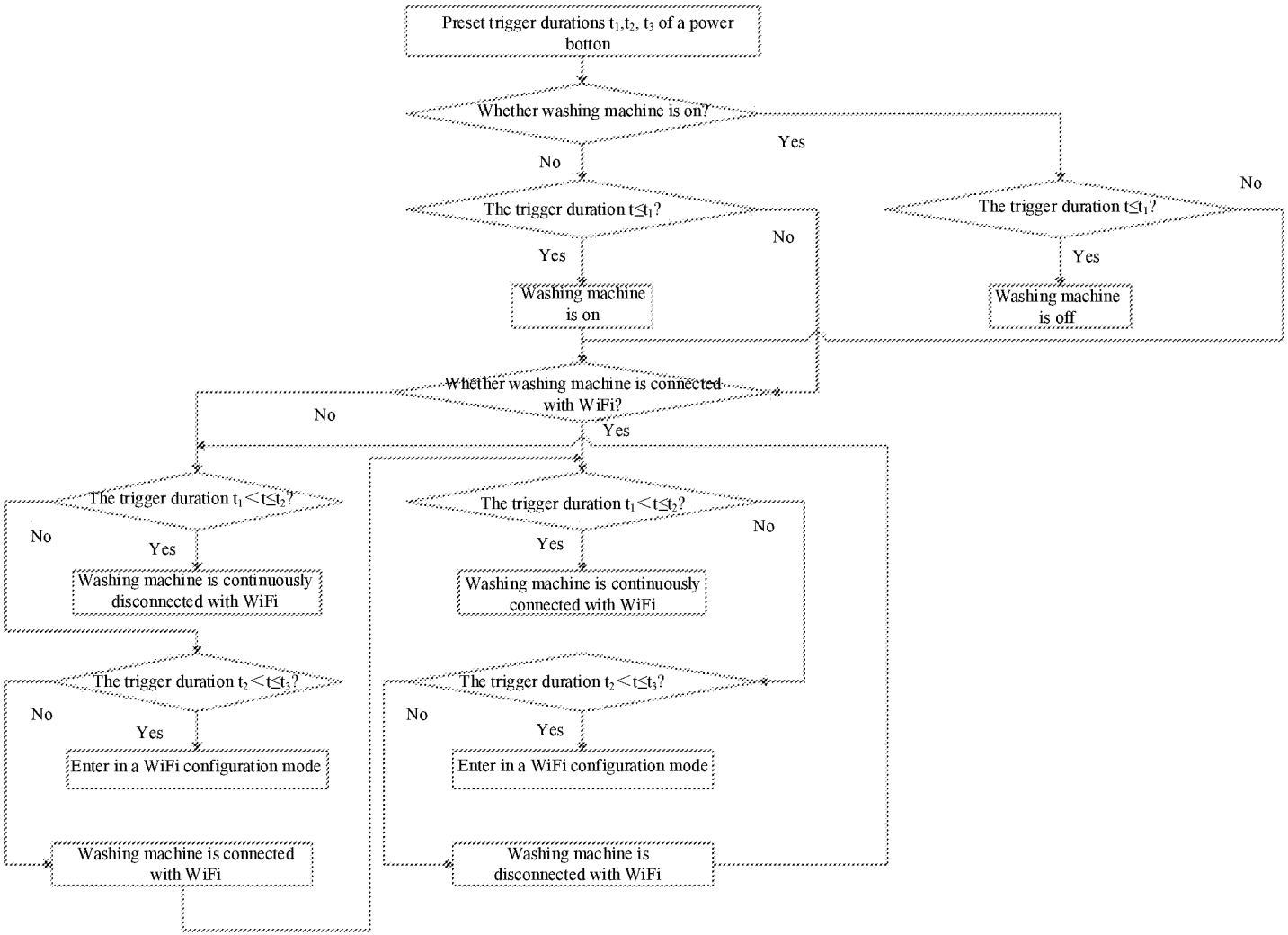
FIG. 1 is a flow diagram of a control method of the present disclosure.

It needs to be illustrated that these accompanying drawings and text descriptions are not intended to limit a concept scope of the present disclosure in any way, but to illustrate the concept of the present disclosure for those skilled in the art with reference to specific embodiments.

DETAILED DESCRIPTION

To make the objectives, technical solutions and advantages of the embodiments of the present disclosure clearer, a clear and complete description of the technical solutions in the present disclosure will be given below, in combination with the accompanying drawings in the embodiments of the present disclosure. The following embodiments are used to illustrate the present disclosure, but not used to limit the scope of the present disclosure.

In the descriptions of the present disclosure, it needs to be illustrated that an orientation or position relationship indicated by terms "up", "down", "front", "after", "left", "right", "vertical", "inner", "outer", etc. is an orientation or position relationship shown based on the accompanying drawings, merely facilitates describing of the present invention and simplifies the descriptions, but does not indicate or hint that referred apparatuses or elements must have specific orientations, and be constructed and operated with the specific orientations, and thus, the relationship cannot be understood as the limitation to the present disclosure.

In the descriptions of the present disclosure, it needs to be illustrated that unless otherwise expressly stipulated and limited, terms "install", "link", and "connect" need to be generally understood, for example, may be a fixed connection, may also be a detachable connection, or an integrated connection; may be a mechanical connection, and may also be an electric connection; and may be a direct link, and may also be an indirect link through an intermediate medium. Those of ordinary skill in the art may understand specific meanings of the above terms in the present disclosure according to specific conditions.

As shown in FIG. 1 to FIG. 4, the present disclosure discloses the control method of a washing machine and the washing machine. Specifically, the washing machine includes control buttons controlling the washing machine to operate, and the washing machine is controlled to be connected with the WiFi by obtaining trigger duration of one of the control buttons; alternatively, the washing machine is controlled to be disconnected with the WiFi; alternatively, the washing machine is controlled to enter in the WiFi configuration mode.

A touch control sensor and a timer are arranged on each control button, once the touch control sensor obtains a touch control signal on the control button, timing is started, timing is ended until the touch control signal disappears, and the trigger duration of the control button is obtained.

The washing machine is controlled to be connected with/disconnected with the WiFi/to enter in the WiFi configuration mode through the trigger duration of the control button, which realizes connection controllability of the washing machine and the WiFi, a user can control whether the washing machine is connected with the WiFi and enters the WiFi configuration mode to configure a connection of the washing machine and the WiFi according to his/her own needs, which avoids conditions that the washing machine is directly connected with the WiFi and the user controls the washing machine by mistake, and the safety of remote control of the washing machine is improved.

As an embodiment of the present disclosure, the control over the washing machine connecting with the WiFi is realized by obtaining the trigger duration of the same control button. The embodiment realizes a purpose of a controllable connection of the washing machine and the WiFi through one control button, a plurality of control buttons are not needed to be arranged on the washing machine, the structure is simple, and production and manufacture are convenient. The washing machine of the embodiment merely needs to be arranged on a basis of an existing washing machine, a structure of the existing washing machine does not need to be changed, and the production and improvement costs are reduced.

As another embodiment of the present disclosure, a plurality of functional buttons are arranged on the washing machine, and different functional buttons respectively realize functions of the washing machine connecting with the WiFi, disconnecting with the WiFi, and entering the WiFi configuration mode. Different functions are realized through the different control buttons, and the control mode is simple.

As an implementation mode of the embodiment, different functional buttons may realize the same function, but sequences of achieving different functions are different. Specifically, the washing machine includes a first control button and a second control button. The first control button is triggered for 5 seconds to realize a function of the washing machine connecting with the WiFi; the first control button is triggered for 10 seconds to realize that the washing machine enters the WiFi configuration mode; and the first control button is triggered for 15 seconds to realize that the washing machine is disconnected with the WiFi.

The second control button is triggered for 5 seconds to realize a function of the washing machine disconnecting with the WiFi; the second control button is triggered for 10 seconds to realize the washing machine entering the WiFi configuration mode; and the second control button is triggered for 15 seconds to realize that the washing machine is connected with the WiFi.

In the implementation, the first control button preferably realizes the function of the washing machine connecting with the WiFi, and the second control button preferably realizes the function of the washing machine disconnecting with the WiFi. Thus, the user may select to touch the first control button or the second control button according to the current connection state of the washing machine and the WiFi.

Specifically, when the washing machine is connected with the WiFi and the user wants to realize that the washing machine is disconnected with the WiFi, the user only needs to temporarily touch the second control button; and when the washing machine is disconnected with the WiFi and the user wants to realize that the washing machine is connected with the WiFi, the user only needs to temporarily touch the first control button. The above control process may quickly realize the purposes of the user, meanwhile, when one of the first control button and the second control button fails, the other control button may control the connection of the washing machine and the WiFi, so as to ensure normal operation of the washing machine.

As another embodiment of the present disclosure, when a washing machine is connected with a WiFi, the washing machine is controlled to be continuously connected/disconnected/continuously connected with the WiFi and enter in a WiFi configuration mode according to an obtained trigger duration of a control button; and when the washing machine is disconnected with the WiFi, the washing machine is controlled to be continuously disconnected with the WiFi/switched on/switched on and enter in the WiFi configuration mode according to the obtained trigger duration of the control button.

According to the embodiment, for current connection and disconnection states of the washing machine and the WiFi, the connection state of the washing machine and the WiFi is respectively controlled through the trigger duration of the control button, the control mode is more reasonable, and the washing machine is effectively prevented from being automatically connected with the WiFi and bringing potential safety hazards to the user.

As yet another embodiment of the present disclosure, a WiFi configuration mode includes a presetting connection time to of a washing machine and a WiFi, such as 3 hours; and a continuous connection time t of the washing machine and the WiFi is obtained, and when the continuous connection time t of the washing machine and the WiFi satisfies $t \geq t_0$, a connection of the washing machine and the WiFi is controlled to enter in a low-power consumption mode.

In the embodiment, the continuous connection time t of the washing machine and the WiFi satisfies $t \geq t_0$, which indicates that the connection time of the washing machine and the WiFi is longer, the user has already completed control use of the washing machine with high probability, and cannot manipulate the washing machine frequently. At the moment, the connection of the washing machine and the WiFi is controlled to enter in the low-power consumption mode, which not only saves electric energy of the washing machine, but also prevents the washing machine from being continuously connected with the WiFi to occupy a home network of the user and reduces the internet speed of the home network.

Further, the low-power consumption mode is that the washing machine is controlled to be automatically disconnected with the WiFi every $\Delta t_1$ time, the washing machine is controlled to be automatically connected with the WiFi after connection for $\Delta t_2$ time, and the process is repeated. Wherein $\Delta t_1$ may be equal to $\Delta t_2$, so that the connection and disconnection of the washing machine and the WiFi are more regular.

Alternatively, $\Delta t_2$ is controlled to increase with increasing of the continuous connection time t of the washing machine and the WiFi. The larger the continuous connection time t of the washing machine and the WiFi, the longer the connection time of the washing machine and the WiFi, the lower the possibility of a user controlling the washing machine again, time of the washing machine occupying the home network signal is further reduced by increasing $\Delta t_2$, and a user network using experience is improved.

As another embodiment of the present disclosure, when the washing machine is connected with a WiFi, a user may control the washing machine to be disconnected with the WiFi through an intelligent terminal. The user subjectively controls a connection state of the washing machine and the WiFi, which further improves connection controllability of the washing machine and the WiFi.

As yet another embodiment of the present disclosure, a washing machine includes a washing procedure and a drying procedure. A WiFi configuration mode includes that in a process of the washing machine executing the washing procedure or the drying procedure, the washing machine is controlled to be automatically disconnected with the WiFi, and when the washing procedure or the drying procedure is terminated, the washing machine is controlled to be automatically connected with the WiFi.

In the embodiment, in the process of the washing machine executing the washing procedure or the drying procedure, a user does not need to control the washing machine in real time, at the moment, the washing machine is controlled to be disconnected with the WiFi, which can effectively prevent the washing machine from occupying a home network signal. When the washing procedure or the drying procedure is terminated, the user may need to control the procedure of the washing machine, at the moment, the washing machine is controlled to be connected with the WiFi, which facilitates remote control over the washing machine by the user.

As yet another embodiment of the present disclosure, a control button is a power button, a trigger duration of the power button is preset to be $t_1$, $t_2$, $t_3$, and $t_1<t_2<t_3$;

when the obtained trigger duration t of the power button is $t \leq t_1$, a washing machine is controlled to be switched on/off; and when the obtained trigger duration t of the power button satisfies $t_1<t \leq t_2$, the washing machine is controlled to be continuously connected/continuously disconnected with a WiFi; specifically, when the washing machine is connected with the WiFi and the obtained trigger duration t of the power button satisfies $t_1<t \leq t_2$, the washing machine is controlled to be continuously connected with the WiFi. When the washing machine is disconnected with the WiFi and the obtained trigger duration t of the power button satisfies $t_1<t \leq t_2$, the washing machine is controlled to be continuously disconnected with the WiFi.

When the obtained trigger duration t of the power button satisfies $t_2<t \leq t_3$, the washing machine is controlled to enter in a WiFi configuration mode; and when the obtained trigger duration t of the power button satisfies $t_3<t$, the washing machine is controlled to be connected/disconnected with the WiFi; when the washing machine is connected with the WiFi and the obtained trigger duration t of the power button satisfies $t_3<t$, the washing machine is controlled to be disconnected with the WiFi; and when the washing machine is disconnected with the WiFi and the obtained trigger duration t of the power button satisfies $t_3<t$, the washing machine is controlled to be connected with the WiFi.

In the embodiment, the power button can not only control the washing machine to be switched on and switched off, but also can control the connection/disconnection/configuration of the washing machine and the WiFi, which realizes the functional diversification of the power button.

Figure 2:
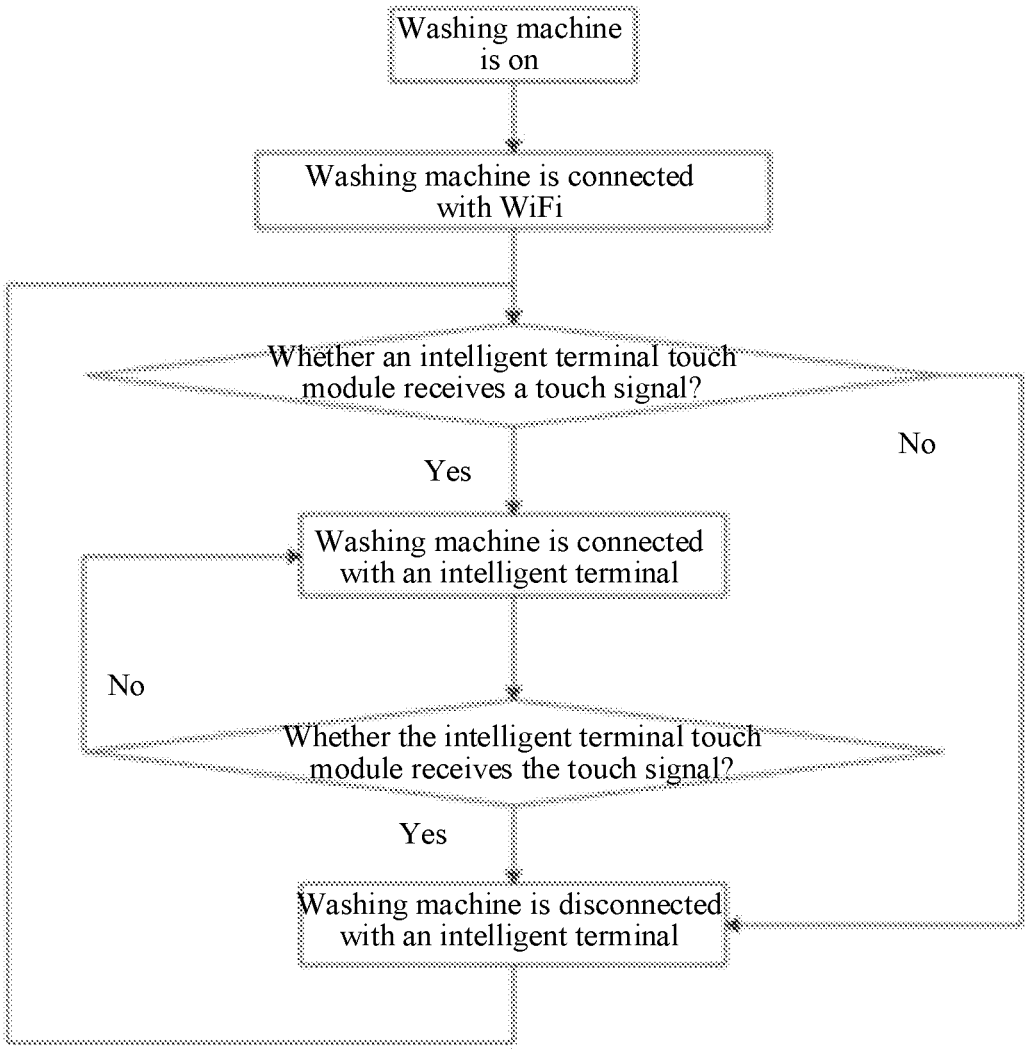
FIG. 2 is another flow diagram of a control method of the present disclosure.

As another embodiment of the present disclosure, as shown in FIG. 2, a washing machine further includes an intelligent terminal touch module, and when the washing machine is connected with a WiFi, the intelligent terminal touch module receives a touch signal to control the washing machine to be connected/disconnected with an intelligent terminal.

Specifically, when the washing machine is connected with the WiFi and is not connected with the intelligent terminal, the intelligent terminal touch module receives the touch signal to control the washing machine to be in a communication connection with the intelligent terminal through a network signal; and when the washing machine has been connected with the intelligent terminal, the touch module receives the touch signal to control the washing machine to be disconnected with the intelligent terminal.

Further, the intelligent terminal touch module includes a remote button, and the remote button has an indicator lamp. When the washing machine is connected with the WiFi and is not connected with the intelligent terminal, the indicator lamp flickers, and the remote button is pressed momently, which authorizes that the washing machine is in the communication connection with the intelligent terminal. After the washing machine is connected with the intelligent terminal, the indicator lamp is normally on. When the washing machine has been connected with the intelligent terminal, the remote button is pressed momently to control the washing machine to be disconnected with the intelligent terminal.

In the embodiment, after the remote button authorizes that the washing machine is in the communication connection with the intelligent terminal, a pause button of the washing machine is touched to enable the washing machine to pause. After the washing machine is paused, when the washing machine meets a condition of opening a door body, the user opens the door body of the washing machine, and a remote authorization is canceled, the indicator lamp flickers, which ensures the safety of the door-opening process. Specifically, when the washing machine is not in a process of washing or rinsing, a condition of opening the door body is met.

After the washing machine is paused, when the washing machine does not meet the condition of opening the door, a state of the remote button authorizes that the washing machine is in the communication connection with the intelligent terminal is continuously kept, the indicator lamp is normally on, and the user conveniently remotely controls the washing machine.

In addition, after the remote button authorizes that the washing machine is in the communication connection with the intelligent terminal, when an app of the intelligent terminal controls the washing machine to pause, the situation that the remote button authorizes that the washing machine is in the communication connection with the intelligent terminal is continuously kept, and the indicator lamp is on normally. When the door body needs to be opened at the moment, the remote button is pressed momently, whether the condition of opening the door body of the washing machine is met is detected, if yes, the washing machine is controlled to be disconnected with the intelligent terminal, the indicator lamp flickers, and the user conveniently opens the door body of the washing machine safely. If not, the state of the remote button authorizing that the washing machine is in the communication connection with the intelligent terminal is continuously kept, the indicator lamp is on all the time, and the user conveniently remotely controls the washing machine.

In the solution, when the condition of opening the door body is met, the remote button controls the washing machine to be disconnected with the intelligent terminal, which prevents the user from remotely controlling the washing machine by mistake and causing potential safety hazards in the process of opening the door body, and the use safety of the washing machine in the process of opening the door body is ensured.

In the embodiment, the intelligent terminal touch module receives the touch signal to control the washing machine to be in the communication connection with the intelligent terminal through the network signal, and the user may remotely control the washing machine through the intelligent terminal without being limited by geography, time and space. When the washing machine has been connected with the intelligent terminal, the touch module receives the touch signal, which indicates that a person or a pet appears nearby the washing machine, the washing machine is controlled to be disconnected with the intelligent terminal, the user is prevented from unknowingly controlling the washing machine to operate and causing harm to the person/pet nearby the washing machine, and the use safety of the washing machine is improved.

Figure 3:
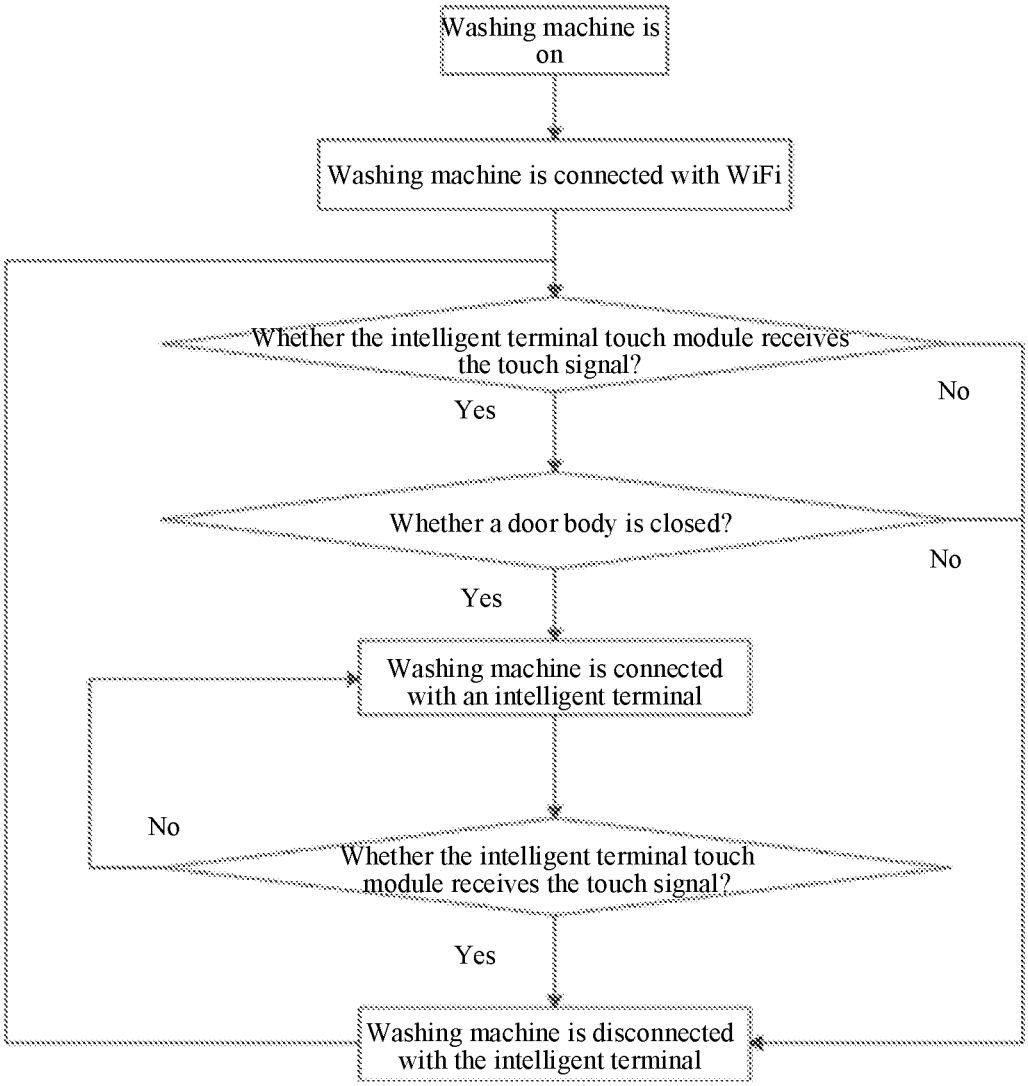
FIG. 3 is another flow diagram of a control method of the present disclosure.

As another embodiment of the present disclosure, as shown in FIG. 3, a washing machine further includes a door body detecting module for detecting whether a door body of the washing machine is closed. When the washing machine is connected with a WiFi, an intelligent terminal touch module receives a touch signal, and when the door body detecting module detects that the door body is closed, the washing machine is controlled to be connected with an intelligent terminal; and otherwise, the washing machine is controlled to be disconnected with the intelligent terminal.

In the embodiment, when the door body detecting module detects that the door body is closed, the washing machine is controlled to be connected with an intelligent terminal, the dangerous situation caused by a user controlling the washing machine to operate through the intelligent terminal without closing the door body is avoided, and the use safety of the washing machine is improved.

Figure 4:
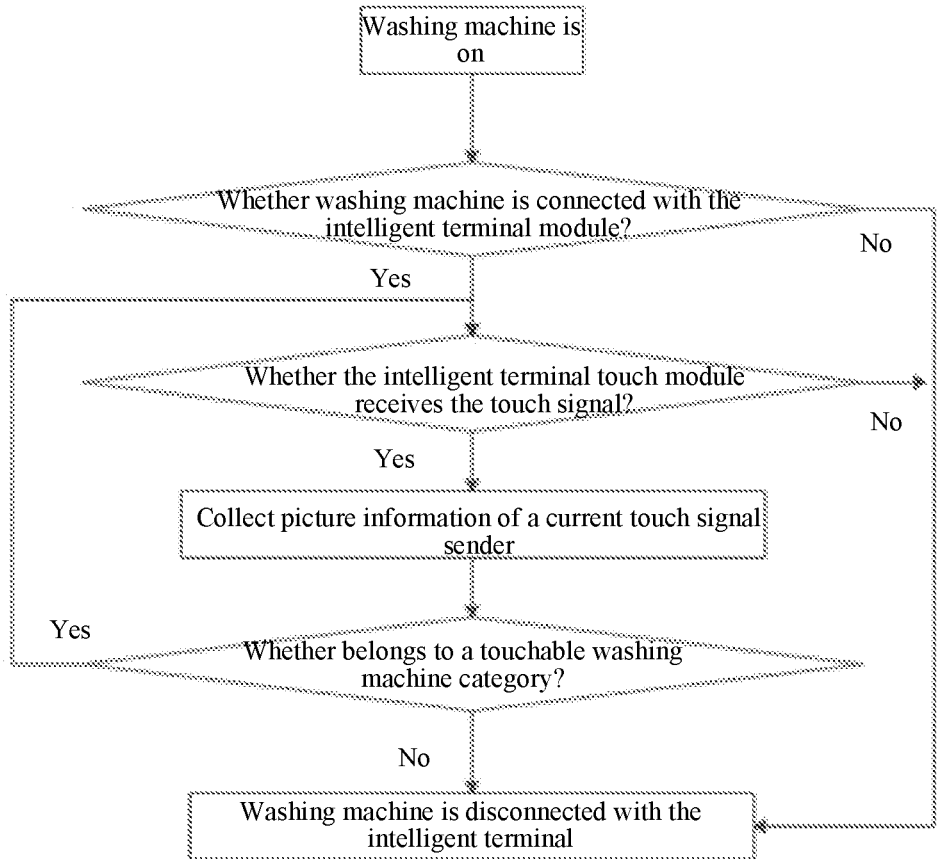
FIG. 4 is another flow diagram of a control method of the present disclosure.

As shown in FIG. 4, as yet another embodiment of the present disclosure, when a washing machine and an intelligent terminal are in a connection state, if an intelligent terminal touch module receives a touch signal, it indicates that a person/pet exists nearby the washing machine, the washing machine is controlled to be disconnected with the intelligent terminal, and a user is prevented from remotely controlling the washing machine to operate and harming the person/pet exists nearby the washing machine.

Preferably, the washing machine includes an image obtaining module. The washing machine/the intelligent terminal prestores picture information of family members to form an information base, and divides the picture information into a touchable washing machine category and an untouchable washing machine category. For example, a kid, the aged and the pet in the family members are classified into the untouchable washing machine category. When the washing machine and the intelligent terminal are in the connection state and the intelligent terminal touch module receives the touch signal, the image obtaining module is controlled to collect picture information of a current touch signal sender, and match the collected picture information with the picture information in the information base.

When the picture information of the current touch signal sender belongs to the touchable washing machine category, the washing machine is controlled to be continuously connected with the intelligent terminal; and otherwise, the washing machine is controlled to be disconnected with the intelligent terminal.

The technical solution of the embodiment ensures the intelligent connection of the washing machine and the intelligent terminal on the premise of ensuring the operation process safety of the washing machine. The washing machine cannot be prone to being disconnected with the intelligent terminal, which avoids that inconvenience is brought to the user controlling the washing machine through the intelligent terminal.

The present disclosure further discloses a washing machine. The washing machine is controlled by any one of the above technical solutions or a combined solution of the above technical solutions. The intelligence degree of the washing machine controlled by the above technical solution is high, the washing machine use safety may be ensured, and the user may remotely control the washing machine to wash clothes through the intelligent terminal.

The above embodiments are merely preferable embodiments of the present disclosure, are not limited to the present disclosure in any way, although the preferable embodiments of the present disclosure are disclosed, are not used to limit the present disclosure, any technical staff familiar to the present disclosure may make some changes or modifications to the equivalent embodiments without departing from the scope of the technical solution of the present disclosure by using technical contents suggested above, however, the contents not separated from the technical solution of the present disclosure, any simple modifications, equivalent changes and modifications being made to the above embodiments according to the technical substance of the present disclosure, all pertain to the scope of the present disclosure.

The invention claimed is:

1. A control method of a washing machine, wherein the washing machine comprises control buttons controlling the washing machine to operate, and the washing machine is controlled to be connected or disconnected with a WiFi or to enter in a WiFi configuration mode by obtaining a trigger duration of one of the control buttons;

the washing machine comprises a washing procedure and a drying procedure, and in a process of the washing machine executing the washing procedure or the drying procedure, the connection of the washing machine and the WiFi is controlled to be automatically disconnected, and when the washing procedure or the drying procedure is terminated, the washing machine is controlled to be automatically connected with the WiFi.

2. The control method of the washing machine according to claim 1, wherein when the washing machine is connected with the WiFi, the washing machine is controlled to be disconnected or remain connected with the WiFi or to enter in the WiFi configuration mode by obtaining the trigger duration of the control buttons; and when the washing machine is disconnected with the WiFi, the washing machine is controlled to remain disconnected or connect to WiFi or enter in the WiFi configuration mode by obtaining the trigger duration of the control buttons.

3. The control method of the washing machine according to claim 2, wherein the WiFi configuration mode comprises presetting a connection duration time to of the washing machine and the WiFi, and obtaining a continuous connection time t of the washing machine and the WiFi, and when the continuous connection time t of the washing machine and the Wifi satisfies $t \geq t_0$, the connection of the washing machine and the WiFi is controlled to enter in a low-power consumption mode.

4. The control method of the washing machine according to claim 1, wherein the WiFi configuration mode comprises presetting a connection duration time to of the washing machine and the WiFi, and obtaining a continuous connection time t of the washing machine and the WiFi, and when the continuous connection time t of the washing machine and the Wifi satisfies $t \geq t_0$, the connection of the washing machine and the WiFi is controlled to enter in a low-power consumption mode.

5. The control method of the washing machine according to claim 4, wherein the low-power consumption mode is that the washing machine is controlled to be automatically disconnected with the WiFi every $\Delta t_1$ time, the washing machine is controlled to be connected with the WiFi after disconnection for $\Delta t_2$ time, and the process is repeated.

6. The control method of the washing machine according to claim 1, wherein the control buttons comprise a power button, a trigger duration of the power button is preset to be $t_1$, $t_2$, $t_3$, and $t_1<t_2<t_3$, when the obtained trigger duration of the power button is less than or equal to $t_1$, the washing machine is controlled to be switched on/off;

when the obtained trigger duration of the power button is greater than $t_1$ and is less than or equal to $t_2$, the washing machine is controlled to remain connected or remain disconnected with the WiFi;

when the obtained trigger duration of the power button is greater than $t_2$ and is less than or equal to $t_3$, the washing machine is controlled to enter in the WiFi configuration mode; and when the obtained trigger duration of the power button is greater than $t_3$, the washing machine is controlled to be connected or disconnected with the WiFi.

7. The control method of the washing machine according to claim 1, wherein the washing machine further comprises an intelligent terminal touch module, and when the washing machine is connected with the WiFi, the intelligent terminal touch module is configured to receive a touch signal to control the washing machine to be connected or disconnected with an intelligent terminal.

8. The control method of the washing machine according to claim 7, wherein the washing machine further comprises a door body detecting module for detecting whether a door body of the washing machine is closed, when the washing machine is connected with the WiFi, if the intelligent terminal touch module receives the touch signal and the door body detecting module detects that the door body is closed, the washing machine is controlled to be connected with the intelligent terminal;

otherwise, the washing machine is controlled to be disconnected with the intelligent terminal.

9. The control method of the washing machine according to claim 8, wherein when the washing machine is connected with the WiFi and is not connected with the intelligent terminal, if the intelligent terminal touch module receives the touch signal, the washing machine is controlled to be connected with the intelligent terminal;

when the washing machine and the intelligent terminal are in a connection state, if the intelligent terminal touch module receives the touch signal, the washing machine is controlled to be disconnected with the intelligent terminal.

10. The control method of the washing machine according to claim 7, wherein the washing machine comprises an image obtaining module, the washing machine or the intelligent terminal prestores picture information of family members to form an information base, and divides the picture information into a touchable washing machine category and an untouchable washing machine category;

when the washing machine and the intelligent terminal are in the connection state and the intelligent terminal touch module receives the touch signal, the image obtaining module is controlled to collect picture information of a current touch signal sender, and match the collected picture information with the picture information in the information base;

when the picture information of the current touch signal sender belongs to the touchable washing machine category, the washing machine is controlled to remain connected with the intelligent terminal; and otherwise, the washing machine is controlled to be disconnected with the intelligent terminal.

11. A washing machine, controlled by adopting the control method of claim 1.

* * * * *